US009015955B2

(12) United States Patent
Vezina et al.

(10) Patent No.: US 9,015,955 B2
(45) **Date of Patent: *Apr. 28, 2015**

(54) COLLAPSIBLE DRYING CONTAINER

(75) Inventors: Jean-François Vezina, Trois-Rivières (CA); Pierrot Lebel, Beauce (CA)

(73) Assignee: Groupe Fitsystèmes inc.

( * ) Notice: Subject to any disclaimer, the term of this patent is extended or adjusted under 35 U.S.C. 154(b) by 603 days.

This patent is subject to a terminal disclaimer.

(21) Appl. No.: 13/371,007

(22) Filed: Feb. 10, 2012

(65) Prior Publication Data

US 2012/0159807 A1 Jun. 28, 2012

Related U.S. Application Data

(63) Continuation-in-part of application No. 12/646,527, filed on Dec. 23, 2009, now Pat. No. 8,141,268.

(51) Int. Cl.

| | |
|---|---|
| ***F26B 19/00*** | (2006.01) |
| ***D06F 58/14*** | (2006.01) |
| ***D06F 58/28*** | (2006.01) |
| ***D06F 59/02*** | (2006.01) |

(52) U.S. Cl.

CPC ..... *D06F 58/14* (2013.01); *D06F 58/28* (2013.01); *D06F 59/02* (2013.01); *D06F 2058/2819* (2013.01); *D06F 2058/2829* (2013.01)

(58) Field of Classification Search

USPC ..... 34/60, 104, 105, 201, 210, 218; 211/85.7, 182, 189; 248/163.1

See application file for complete search history.

(56) References Cited

U.S. PATENT DOCUMENTS

| | | | | | |
|---|---|---|---|---|---|
| 2,975,529 | A | | 3/1961 | Weber | |
| 3,160,482 | A | * | 12/1964 | Foote | 34/665 |
| 3,298,578 | A | * | 1/1967 | Shields | 223/67 |
| 3,432,939 | A | | 3/1969 | Eichholz | |
| 3,513,564 | A | | 5/1970 | Grampire | |
| 3,577,650 | A | * | 5/1971 | Brahm | 34/622 |
| 3,626,602 | A | | 12/1971 | Glowacki | |
| 3,835,552 | A | | 9/1974 | Lord | |
| 3,858,331 | A | | 1/1975 | Lord | |
| 4,593,841 | A | | 6/1986 | Lange | |
| 4,625,432 | A | | 12/1986 | Baltes | |
| 4,777,737 | A | | 10/1988 | Wolens et al. | |

(Continued)

FOREIGN PATENT DOCUMENTS

| | | |
|---|---|---|
| CA | 2091612 | 9/1994 |
| CA | 2241524 | 12/1998 |

(Continued)

OTHER PUBLICATIONS

European Search Report EP10195991.

*Primary Examiner* — Steve M Gravini
(74) *Attorney, Agent, or Firm* — Benoît & Côté Inc.

(57) ABSTRACT

The present document describes a container for storing and drying garments or sport equipment, the container comprising an external envelope comprising a resistant material; and a ventilation structure through which air can be blown for drying the garments or sports equipment, the ventilation structure supporting the external envelope, the ventilation structure comprising hanging elements for hanging the garments or sports equipment thereon, the ventilation structure capable of adopting a retracted position and an extended position in which the ventilation structure occupies more space than in the retracted position.

21 Claims, 12 Drawing Sheets

(56) References Cited

U.S. PATENT DOCUMENTS

| | | | | |
|---|---|---|---|---|
| 4,873,773 | A | 10/1989 | Canonge | |
| 5,175,944 | A * | 1/1993 | Fruehauf | 34/88 |
| 5,369,892 | A | 12/1994 | Dhaemers | |
| 5,377,849 | A * | 1/1995 | Martin | 211/85.7 |
| 5,490,712 | A | 2/1996 | Drelick | |
| 5,528,840 | A | 6/1996 | Pajak et al. | |
| 5,546,678 | A | 8/1996 | Dhaemers | |
| 5,548,100 | A | 8/1996 | Miller | |
| 5,555,648 | A * | 9/1996 | Griffin | 34/621 |
| 5,592,750 | A * | 1/1997 | Eichten | 34/104 |
| RE35,834 | E | 7/1998 | Miller | |
| 5,816,417 | A | 10/1998 | Reaves | |
| 5,833,083 | A | 11/1998 | Miller | |
| 5,930,915 | A | 8/1999 | Dhaemers | |
| 6,041,517 | A * | 3/2000 | Wang | 34/439 |
| 6,134,806 | A * | 10/2000 | Dhaemers | 34/404 |
| 6,327,792 | B1 * | 12/2001 | Hebert | 34/104 |
| 6,780,101 | B2 * | 8/2004 | Buhler et al. | 34/437 |
| 6,860,032 | B2 | 3/2005 | Meyer | |
| 6,880,711 | B2 | 4/2005 | Collier | |
| 7,083,055 | B1 | 8/2006 | Ambrosat | |
| 7,103,989 | B2 * | 9/2006 | Rosseau et al. | 34/104 |
| 7,328,780 | B2 | 2/2008 | Hawthorne | |
| 7,481,065 | B2 | 1/2009 | Krieger | |
| D644,383 | S | 8/2011 | Mangano | |
| 8,038,963 | B1 | 10/2011 | Chen | |
| 8,141,268 | B2 * | 3/2012 | Vezina et al. | 34/104 |
| 8,393,482 | B2 * | 3/2013 | Durham | 211/85.7 |
| 8,404,179 | B2 * | 3/2013 | Antinozzi | 422/5 |
| 8,726,534 | B2 * | 5/2014 | Chappell et al. | 34/202 |
| 2004/0068888 | A1 * | 4/2004 | Lurie | 34/90 |
| 2006/0137206 | A1 | 6/2006 | Lee | |
| 2007/0187345 | A1 | 8/2007 | Hought | |
| 2008/0222909 | A1 | 9/2008 | Picozza et al. | |
| 2009/0083989 | A1 * | 4/2009 | Wang | 34/442 |
| 2009/0113753 | A1 | 5/2009 | Pepper et al. | |
| 2009/0134104 | A1 | 5/2009 | Victory et al. | |
| 2011/0114577 | A1 | 5/2011 | Denike | |
| 2011/0146098 | A1 | 6/2011 | Vézina et al. | |
| 2012/0159807 | A1 * | 6/2012 | Vezina et al. | 34/562 |

FOREIGN PATENT DOCUMENTS

| | | | |
|---|---|---|---|
| CA | 2295511 | | 1/1999 |
| CA | 2206607 | | 2/2000 |
| CA | 2314815 | | 2/2001 |
| CA | 2541447 | | 9/2007 |
| EP | 0368714 | A1 * | 5/1990 |
| EP | 627519 | | 12/1994 |
| EP | 0627519 | A | 12/1994 |
| FR | 2866262 | A1 * | 8/2005 |
| GB | 693368 | * | 7/1953 |

* cited by examiner

COLLAPSIBLE DRYING CONTAINER

CROSS-REFERENCE TO RELATED APPLICATIONS

This application is filed under 37 CFR 1.53(b) as a continuation-in-part application. This application claims priority under 35 USC §120 of U.S. patent application Ser. No. 12/646,527 filed on Dec. 23, 2009, the specification of which is hereby incorporated by reference.

TECHNICAL FIELD

This description relates to the field of bags and containers. More particularly, this description relates to bags, or containers, for storing and drying garments or sports equipment.

BACKGROUND

Sports players often find themselves away from home for extended periods of time and do not have an easy means of drying their equipment. Between sports event away from home, most often the equipment remains wet in a close bag. At best, bags are left open or have mesh portion letting humidity slowly exit the bag.

There is therefore a need for improved bags, or improved containers in which drying of equipment will be improved.

SUMMARY

According to an embodiment, there is provided a container for storing and drying garments or sport equipment, the container comprising an external envelope comprising a resistant material; and a ventilation structure through which air can be blown for drying the garments or sports equipment, the ventilation structure supporting the external envelope, the ventilation structure comprising hanging elements for hanging the garments or sports equipment thereon, the ventilation structure capable of adopting a retracted position and an extended position in which the ventilation structure occupies more space than in the retracted position.

According to an embodiment, the ventilation structure comprises tubing through which air can be blown and capable of adopting a retracted position and an extended position in which the occupies more space than in the retracted position, the tubing comprising at least some of the hanging elements.

According to an embodiment, the tubing comprises at least one of a flexible portion, a pivot portion, and a sliding portion enabling the retracted position and the extended position.

According to an embodiment, the ventilation structure further comprises a retractable frame having ventilation holes through which air can be blown for drying the garments or sports equipment, the retractable frame supporting the external envelope.

According to an embodiment, the retractable frame further comprises frame sections enabling the retracted position and the extended position.

According to an embodiment, the frame sections are capable of at least one of: collapsing into or along each other; and folding toward each other thereby changing the space occupied by the retractable frame According to an embodiment, the ventilation structure comprises an air input and a plurality of air outputs for blowing air on the garments or sports equipment.

According to an embodiment, the container further comprises a ventilator mounted to the ventilation structure and connected to the air input of the ventilation structure for providing the blown air.

According to an embodiment, the ventilator further comprises a timer for controlling an operating time of the ventilator.

According to an embodiment, the container further comprises a battery pack mounted on the ventilation structure for providing electrical power to the ventilator.

According to an embodiment, the container further comprises an electrical cord for connecting the ventilator to an electrical outlet to provide electrical power to the ventilator.

According to an embodiment, the external envelope comprises an air entry port for providing fresh air to the ventilator.

According to an embodiment, the container further comprises at least one of a temperature sensor and a hygrometry sensor for evaluating temperature and hygrometry in the container respectively.

According to an embodiment, the container further comprises at least one of: a disinfectant dispenser mounted on the ventilation structure for dispensing a disinfectant composition to the garments or sports equipment; and an odor dispenser mounted on the ventilation structure for dispensing an odoriferous composition to the garments or sports equipment.

According to an embodiment, the container further comprises at least one of a temperature level indicator and a hygrometry level indicator.

According to an embodiment, the container further comprises at least one aerated compartment extending from the external envelope through which air can be blown for drying the garments or sports equipment in the at least one aerated compartment.

According to an embodiment, the external envelope comprises a flexible resistant material.

According to another embodiment, the container is a bag.

According to another embodiment, the ventilation structure is capable of adopting an intermediate position between the retracted position and the extended position for hanging the garments or the sports equipment.

According to another embodiment, the tubing of the ventilation structure is capable of adopting a retracted position inside the frame or the retractable frame.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Figure 1:
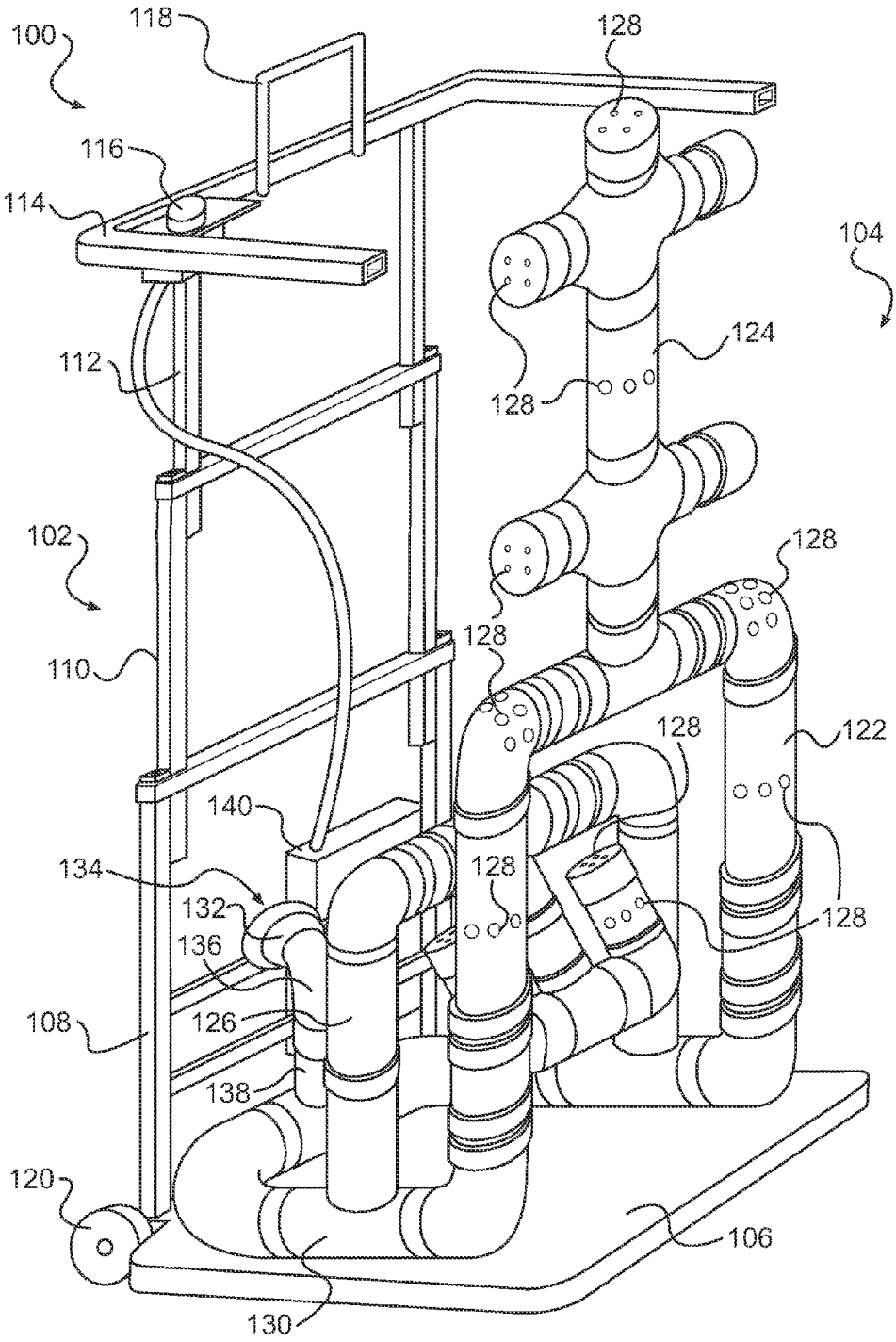
FIG. 1 is a perspective view of an internal structure of a container in an extended position in accordance with an embodiment.
Figure 3:
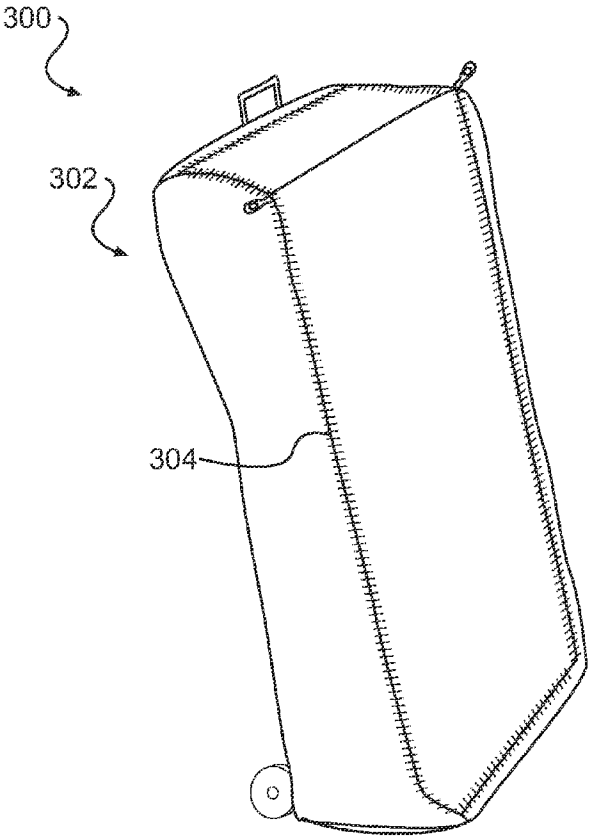
FIG. 3 is a perspective view of the exterior of the container in the extended position.

Referring now to the drawings, and more particularly to FIGS. 1 and 3, a perspective view of an internal structure 100 of a container 300 is shown according to an embodiment. The container 300 for storing and drying garments or sports equipment comprises an external envelope 302 substantially made of flexible resistant material; a frame 102 supporting the external envelope 302 and comprising frame sections 108, 110 and 112 capable of adopting a retracted position and an extended position in which the frame occupies more space than in the retracted position; and a structure 104 for hanging the garments or sports equipment and through which air can be blown for drying the hung garments or sports equipment, the structure for mounting on the frame and comprising structure sections capable of adopting a retracted position and an extended position in which the structure occupies more space than in the retracted position. According to an embodiment, the frame 102 and the structure 104 could be integrated; that is, for example, the frame 102 can support the external envelope 302, and be for hanging garments while providing an air passage through which air can be blown for drying the garments or equipment.

Still referring to FIG. 1, the internal structure 100 comprises a frame 102 and a tubular structure 104 mounted on the frame 102. The frame 102 comprises a base 106 and frame sections 108, 110 and 112. The frame section 108 is fixed to the base 106. The frame section 112 is slidable with respect to the frame section 110 which is itself slidable with respect to the frame section 108. Thereby, the frame sections 108, 110 and 112 are capable of adopting a retracted position and an extended position in which the frame 102 occupies more space than in the retracted position. In FIG. 1, the frame 102 is shown in the extended position.

According to an embodiment, a U-shaped arm 114 is transversally mounted on the frame section 112 at an upper end thereof. The U-shaped arm 114 is opposite the base 106 and defines the volume of the container. On the U-shaped arm 114 a controller 116 and a handle 118 are fixed. Alternatively, the handle 118 can be slidably mounted to the U-shaped arm 114 or to another part of the frame 102.

According to an embodiment, a pair of wheels 120 is pivotally coupled to the base 106. The handle 118 and the wheels 120 allow rolling (i.e., moving) the container easy for transportation. The pair of wheels 120 may rotate in all directions to facilitate the transport.

The structure 104 (according to an embodiment, the tubular structure 104) is designed for hanging garments or sports equipment such as jerseys, shoes, skates, socks, pants, hats, wetsuits, bodyskins, bodysuits, helmets, shoulder pads, elbow pads, mouth guards, protective gloves, heavily padded shorts (also known as hockey pants), athletic cup/jock straps, shin pads, neck protectors, neck guards, chest protectors, blockers, catch gloves, leg pads, ski boots, gloves, mittens, goggles, ski goggles, helmet or the like.

The tubular structure 104 comprises a network of structure sections 122, 124, 126 and 130 (according to an embodiment, tube sections 122, 124, 126 and 130) connected together in which air can be blown. The air can be heated or mixed with a vapor of fragrance or disinfectant (also referred to herein as an odoriferous composition and a disinfectant composition, respectively). At given locations air outputs 128 provide gas exhausts for drying or disinfecting garments or sport equipment hung to the tubular structure 104. It is to be noted that the disinfectant dispenser may include a molecule which allows the destruction of odors such as, without limitations, a lamp berger in the disinfectant dispenser.

The tube section 124 can pivot with respect the tube section 122 between arms of the tube section 122. The tube sections 122 and 126 can telescopically slide toward the tube section 130. Tube sections 122, 124 and 126 are capable of adopting a retracted position and an extended position in which the tubular structure 104 occupies more space than in the retracted position. Presently, the tubular structure 104 is shown in the extended position.

A specific tubular structure 104 may be designed for each use the container. For example, a hockey player's equipment is quite different from the equipment of a football player. In each case, each piece of equipment has its location adapted for it. In each case, the tubular structure 104 is adapted to provide best drying performance and to occupy less space possible. Thereby, such a container makes it easier for a user to check for the presence of his equipment. Pictograms, not shown, are fixed at accurate locations on the internal structure 100 for precisely identifying storing location of each piece of equipment. This allows a user to easily take stock of his equipment and prevents him from forgetting an item of equipment.

On the frame 102, more precisely on the frame section 108, is mounted a ventilator 132. The ventilator 132 as an input 134 for vacuuming air from outside the container and an output 136. The output 136 is fluidly connected to an air input 138 of the tube sections 130 for blowing air everywhere in the tubular structure 104. Optionally the ventilator 132 comprises a heating means for heating air or a dispensing means for dispensing vapor or micro drops of fragrance or disinfectant. A disinfectant dispenser allows disinfecting garments or sports equipment alternatively during the drying or during a specific disinfectant program. An odor dispenser may also be provided for dispensing an odoriferous composition to the garments or sports equipment. It is to be noted that the heating means may be integrated in the ventilator 132. However, the ventilator 132 and the heating means may be two different structural elements of the bag 300.

The ventilator 132 provides an air pressure to the air input 138 which is controllable by the controller 116. The ventilator 132 is controlled by the controller 116 which measures temperature and hygrometry (or humidity) inside the container using a temperature sensor and a hygrometry sensor and switches modules of the ventilator 132 on and off depending on detected levels of temperature and hygrometry. Also, the ventilator 132 is controlled by the controller 116 which measures temperature and hygrometry inside the container using a temperature sensor and a hygrometry sensor and modulates the speed of the ventilator 132 depending on detected levels of temperature and hygrometry to permit important energy conservation.

A power supply 140 is also mounted on the frame 102, more precisely on the frame section 108. The power supply 140 optionally comprises a battery pack for independently providing electrical power to the ventilator 132. The power supply 140 alternatively comprises a releasable connection (e.g., electrical cord) for connecting to a building outlet. Optionally, the ventilator 132, its power supply 140 and its controller 116 can be comprised in an external unit separated from the container. The external unit can be connected to the container by a flexible pipe. Alternatively, the power pack comprises a timer to switch modules of the ventilator 132 on and off depending on the temperature and hygrometry inside the container. The timer estimates the release time to reach a desired level of temperature and hygrometry inside the container. A temperature indicator and a hygrometry indicator may be installed on the container. As an option, the controller may be programmable using a user interface to set temperature and/or hygrometry thresholds to start or stop the ventilator 132.

Figure 2:
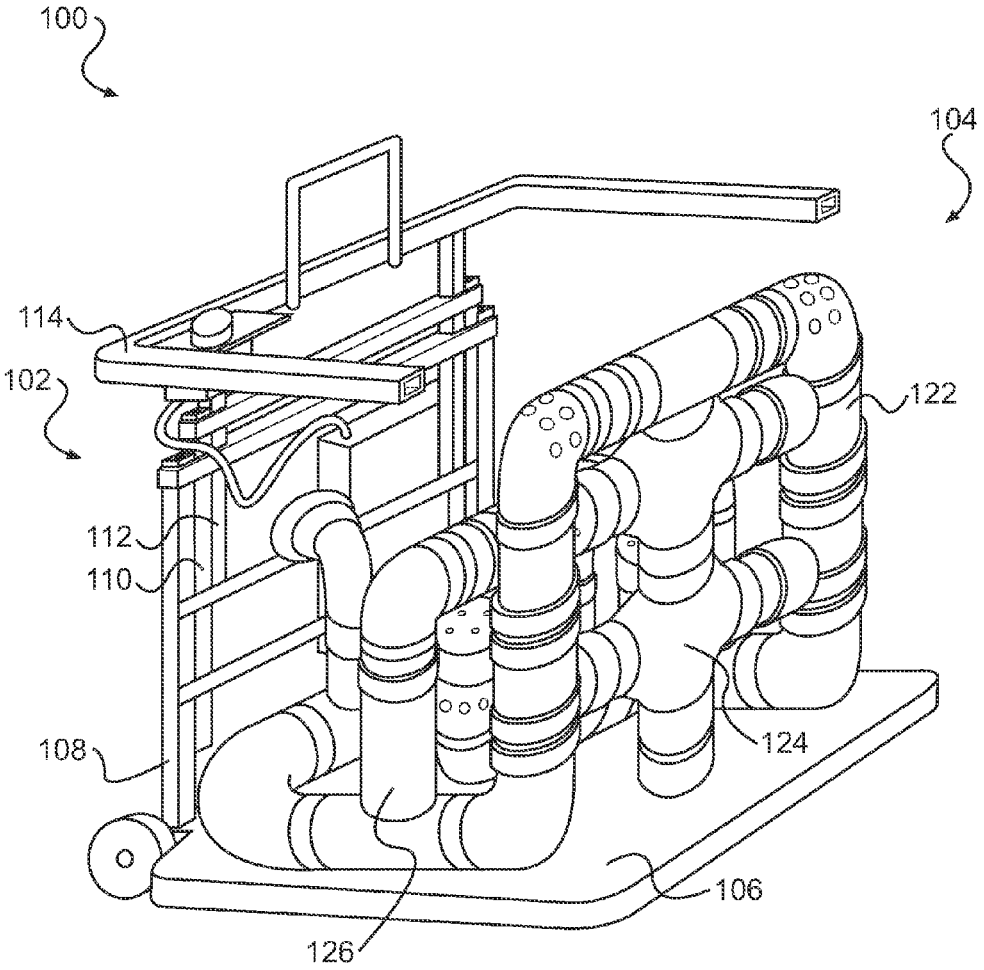
FIG. 2 is a perspective view of the portion of the container of FIG. 1 in a retracted position.

Referring to FIG. 2, there is shown the internal structure 100 of the container in the retracted position. The frame sections 108, 110 and 112 are collapsed into each other and folded toward each other thereby reducing the space occupied by the frame 102. A space defined by the base 106 opposite the U-shaped arm 114 is reduced compared with the space similarly defined but in the extended position, as shown on FIG. 1. Also, the tube sections 122, 124 and 126 are collapsed into each other and fold toward each other thereby reducing the space occupied by the tubular structure 104. Tube section 124 has been collapsed and pivoted between arms of the tube section 122.

Figure 4:
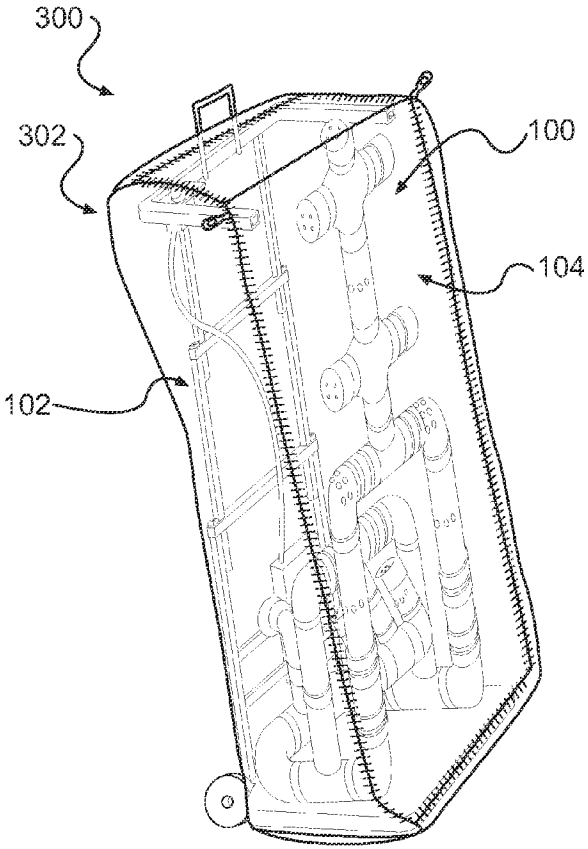
FIG. 4 is a perspective view from the exterior of the container of FIG. 3 showing its external envelope partially in transparency.

Concurrently referring to FIG. 3 and FIG. 4, there is shown a container 300 comprising an external envelope 302 and the internal structure 100 inside the envelope, in the extended position. The frame 102, especially the base 106 and the U-shaped arm 114 support the external envelope 302. The external envelope 302 is made of a flexible resistant material for being folded and unfolded and for staying in good condition after some years of rough usage. Located at a hidden face of the container 300, the envelope comprises an air entry port for proving fresh air to the ventilator 132 via the input 134 of the ventilator 132. It is noted that a support (not shown) may also be included on the external envelope 302 to support sport equipment (hockey stick, baseball bat, pair of skis, ski poles and the like). The support may be, without limitation, a case, a sleeve, an elastic support attachment, a rope, a string and the like.

A zipper 304 runs around the external envelope 302, or follows any suitable configuration on the external envelope, for opening the external envelope 302 and providing an access inside the container and to the tubular structure to install and remove garments or sports equipment. The zipper 304 may also include a plurality of zipper. Any other type of fastener, such as buttons or Velcro™, can be used to replace or complement zipper 304. In the extended position, the container 300 contains all the equipment for drying and for storing awaiting the next use. It is envisioned that returning form a competition, equipment is washed and directly put in the container 300 for drying. The container 300 is advantageous because no other support or arrangement is necessary and no additional space is necessary.

Figure 5:
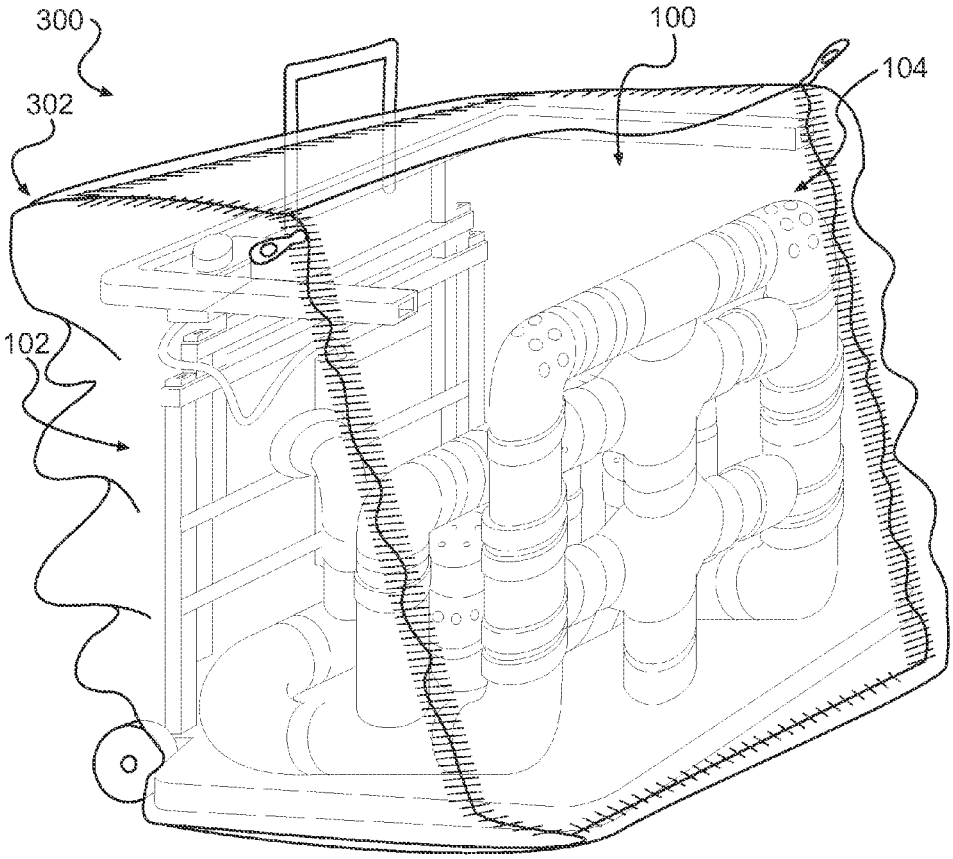
FIG. 5 is a perspective view from the exterior of the container of FIG. 3 in a retracted position, showing its external envelope partially in transparency.

In FIG. 5, there is shown the container 300 in the retracted position. The frame 102 and the tubular structure 104 are collapsed. The external envelope 302 is folded around the internal structure 100 not to significantly exceed the volume of the frame 102 in the retracted position. The retracted position of the container 300 is advantageous especially in changing rooms while the equipment is worn. There are generally no specific lockers and not enough space to comfortably contain containers for a whole team. The retracted position allows putting the container 300 under benches thereby making circulation easier in the room.

Figure 6:
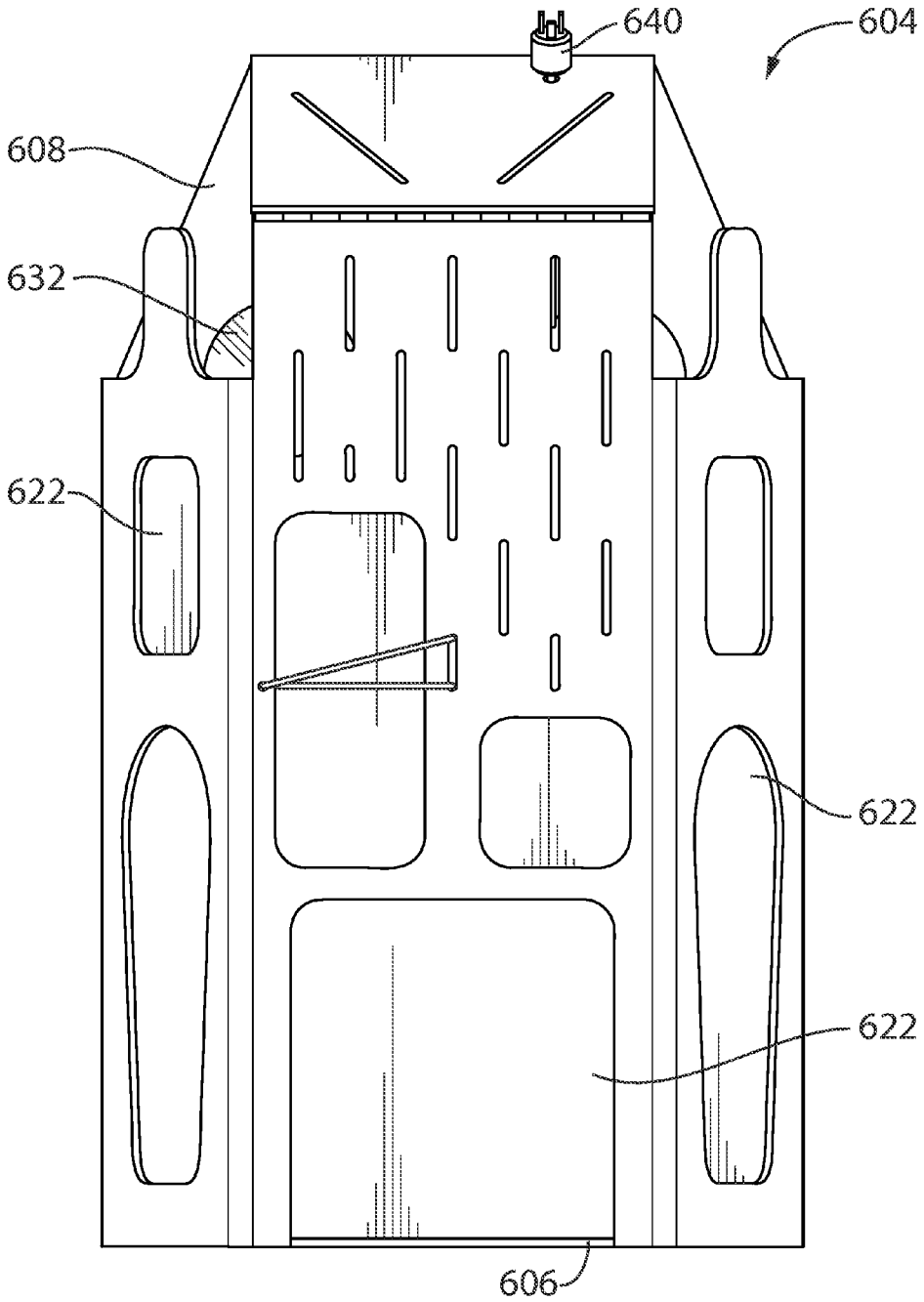
FIG. 6 is a front elevational view of the nested structure of a container in an extended position in accordance with another embodiment.
Figure 8:
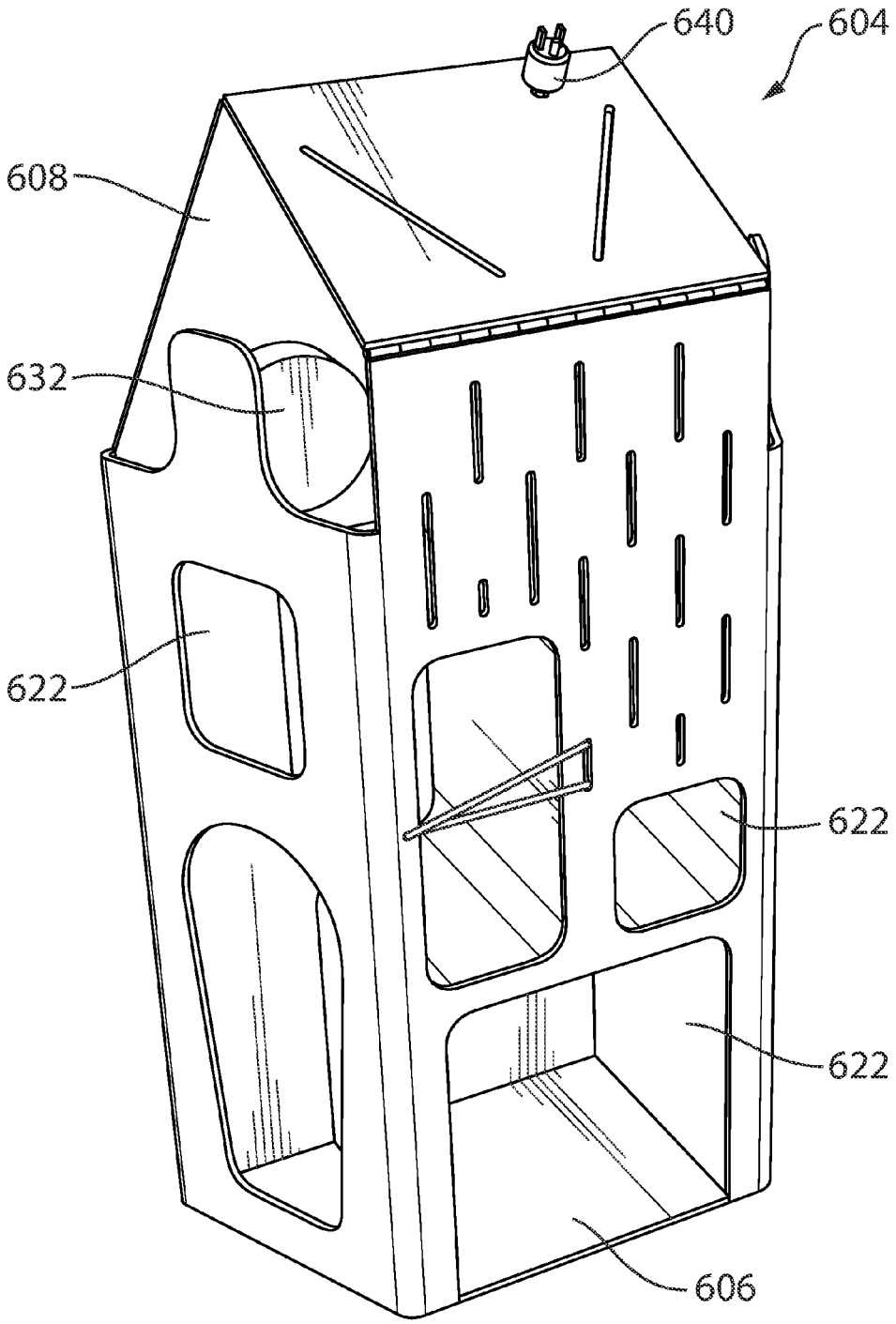
FIG. 8 is a front perspective view of the nested structure of FIG. 6.
Figure 9:
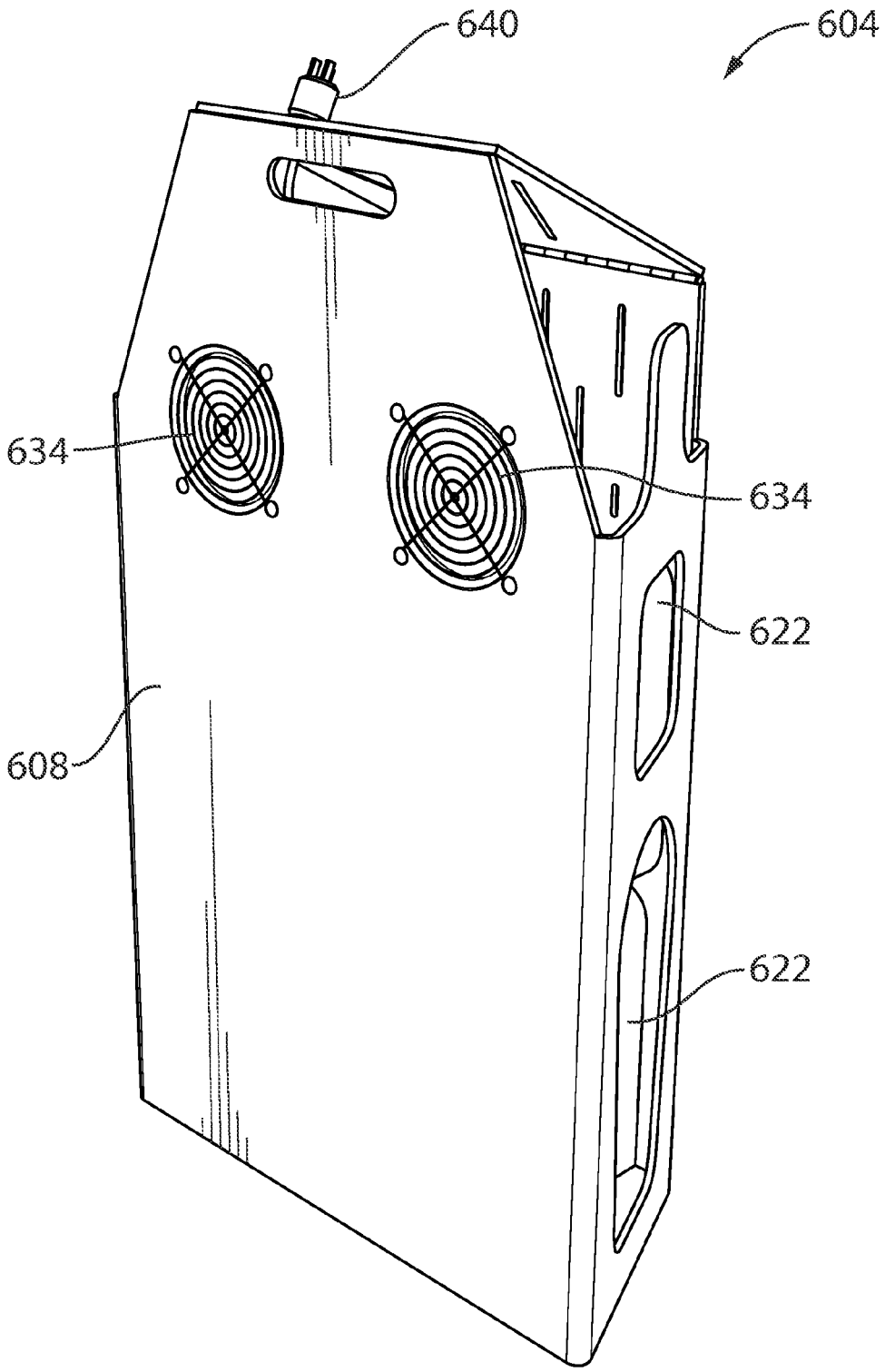
FIG. 9 is a back perspective view of the nested structure of FIG. 6.

Concurrently referring to FIG. 6, FIG. 8 and FIG. 9, the nested structure 604 of a container is shown according to another embodiment.

The nested structure 604 comprises a base 606 and nested sections 622. The nested structure 604 is retractable with respect to the frame 602 (see FIG. 7) which is itself retractable or foldable. It is noted that the tubular structure 104 of FIGS. 1, 2, 4 and 5 may be juxtaposed with the nested structure 604, as shown in FIG. 6, to be incorporated in the container 700. In this case, certain sport equipments (gloves, skates, boots and the like) may be hanged on the tubular structure 104 while others (hockey pads, helmet, and the like) are stored in the nested structure 604. Also, the nested sections may be made, without limitations, of fabric, plastic and the like. In FIG. 6, the nested structure 604 is shown in the extended position. Additionally, although not shown, the nested structure 604 may be retractable, collapsible or foldable. In such a structure, some parts would be made of netting material or fabric material while others, such as parts of the nested sections 622, would be provided with some rigid structural elements.

The nested structure 604 is designed for hanging and storing garments or sports equipment such as jerseys, shoes, skates, socks, pants, hats, wetsuits, bodyskins, bodysuits, helmets, shoulder pads, elbow pads, mouth guards, protective gloves, heavily padded shorts (also known as hockey pants), athletic cup/jock straps, shin pads, neck protectors, neck guards, chest protectors, blockers, catch gloves, leg pads, ski boots, gloves, mittens, goggles, ski goggles, helmet or the like.

The nested structure 604 may comprise a network of nested sections 622, in which air can be blown. The air can be heated or mixed with a vapor of fragrance or disinfectant. At given locations, air outputs provide gas exhausts for drying or disinfecting garments or sport equipment stored in the nested sections 622 or hung to the nested structure 604. A nested section 622 may be embodied by, without limitation, a shelf, a net, a rack and the like.

A specific nested structure 604 may be designed for each use the container. For example, a hockey player's equipment is quite different from the equipment of a football player. In each case, each piece of equipment has its location adapted for it. In each case, the nested structure 604 is adapted to provide best drying performance and to occupy less space possible. Thereby, such a container makes it easier for a user to check for the presence of his equipment. Pictograms, not shown, are fixed at accurate locations on the nested structure 604 for precisely identifying storing location of each piece of equipment. This allows a user to easily take stock of his equipment and prevents him from forgetting an item of equipment.

On the nested structure 604, more precisely on the back section 608, are mounted two ventilators 632 (only one of which is shown). The ventilators 632 have inputs 634 for vacuuming air from outside the container. The input 634 is fluidly connected to a container air input 638. The nested sections 622 receive air from ventilator 632 for blowing air everywhere in the nested structure 604.

Ventilators 632 provide an air pressure through the air input 634 which is controllable by a controller (not shown). Ventilator 632 is controlled by the controller which measures/detects/evaluates temperature and hygrometry inside the container and switches modules of ventilators 632 on and off depending on given instructions: volume inside de container, or other conditions. The volume inside the container may be estimated using a detector which can evaluate/measure/detect, for example, the position of the frame sections or the structure sections relative to each other.

Figure 7:
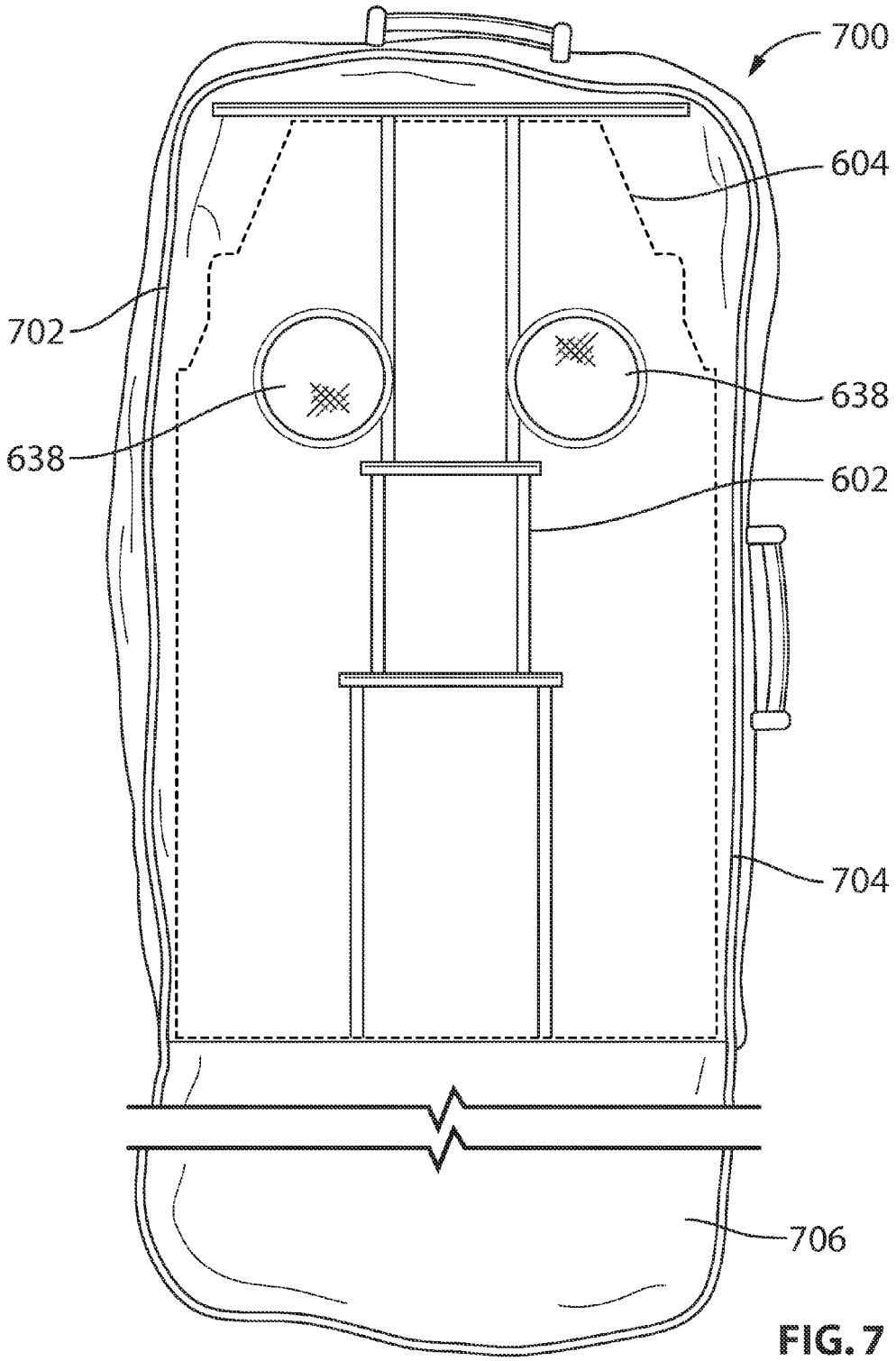
FIG. 7 is a partial front elevational view of the exterior of the container in the extended position, showing the interior of the container showing in stippled lines the outline of the internal structure.

A power supply (not shown) is also mounted on the nested structure 604 (see FIG. 7). The power supply optionally comprises a battery pack for independently providing electrical power to the ventilator 632. The power supply alternatively comprises a releasable connection 640 (e.g., electrical cord) for connecting to a building outlet. Optionally, ventilators 632, its power supply and its controller can be comprised in an external unit separate from the container. The external unit can be connected to the container by a flexible pipe. Alternatively, the power pack comprises a timer to switch modules of the ventilator 632 on and off depending on the temperature and hygrometry inside the container. The timer estimates the release time to reach a desired level of temperature and hygrometry inside the container. A temperature indicator and a hygrometry indicator may be installed on the container. As an option, the controller may be programmable using a user interface to set temperature and/or hygrometry thresholds to start or stop the ventilator 632.

Referring now to FIG. 7, there is shown a container 700 comprising an external envelope 702 and a front cover 706, in the extended position. The outline of nested structure 604 is shown in stippled lines. The frame 602 supports the external envelope 702. Frame 602 is made of multiple sliding sections which can selectively slide toward each other resulting in a reduction in size of frame 602 and hence container 700. The external envelope 702 is made of a flexible resistant material for being folded and unfolded and for staying in good condition after some years of rough usage. Located at a hidden face of the container 700, the envelope comprises an air entry port for proving fresh air to the ventilator 632 via the input 634 of the ventilator 632.

A zipper 704 runs around the envelope 702 for releasing, in part, the front cover 706 and thereby opening the envelope 702 and providing an access inside the container and to the nested structure to install and remove garments or sports equipment. Any other type of fastener, such as buttons or Velcro™, can be used to replace or complement zipper 704. In the extended position, the container 700 contains all the equipment for drying and for storing awaiting the next use. It is envisioned that returning from a competition, equipment is washed and directly put in the container 700 for drying. The container 700 is advantageous because no other support or arrangement is necessary and no additional space is necessary. Finally, the tubular structure 104 or the nested structure 604 may include radiant elements to dry sport equipments.

Figure 10:
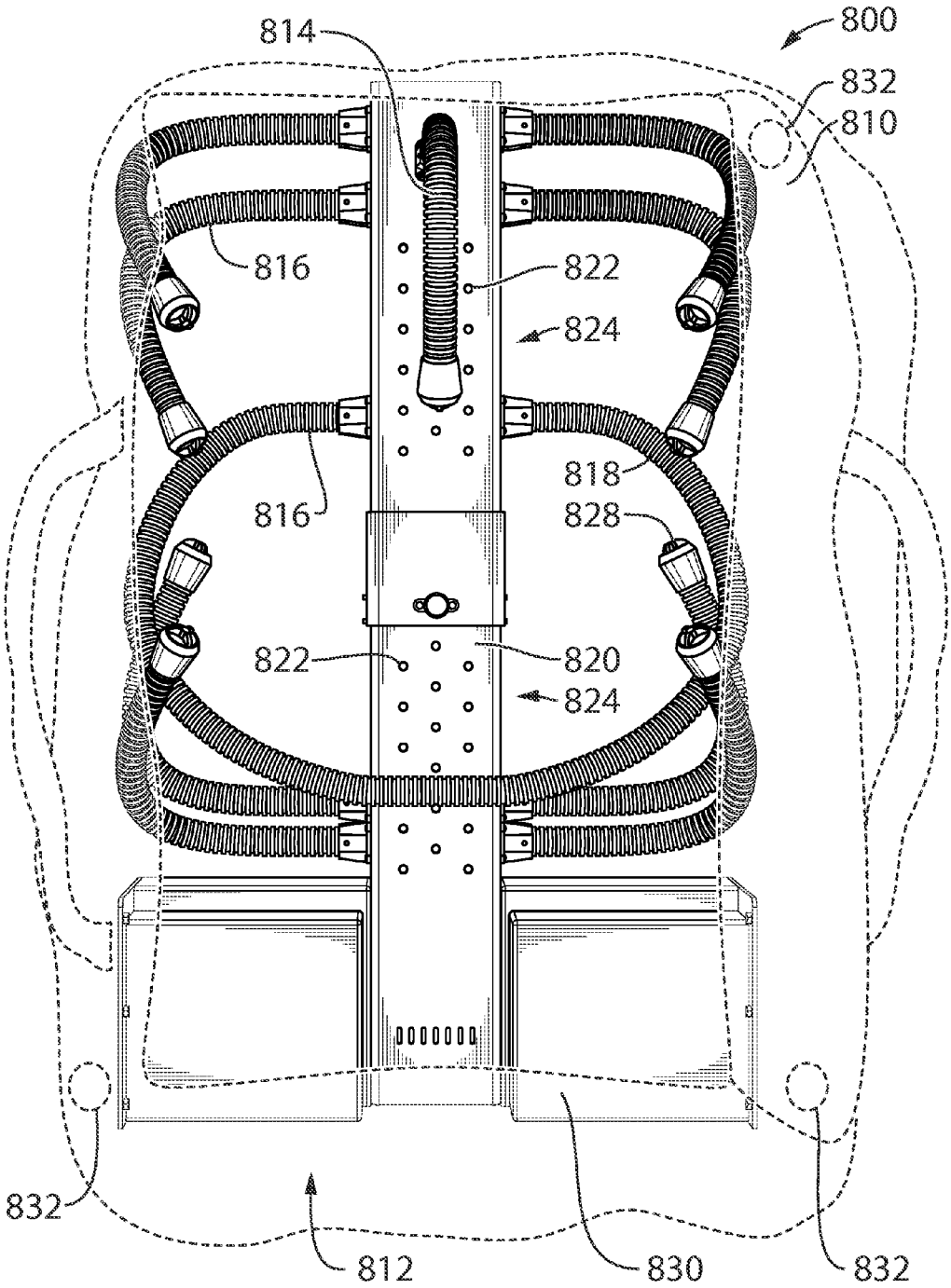
FIG. 10 is a front perspective view of a ventilation structure in a container in an extended position in accordance with another embodiment.
Figure 11:
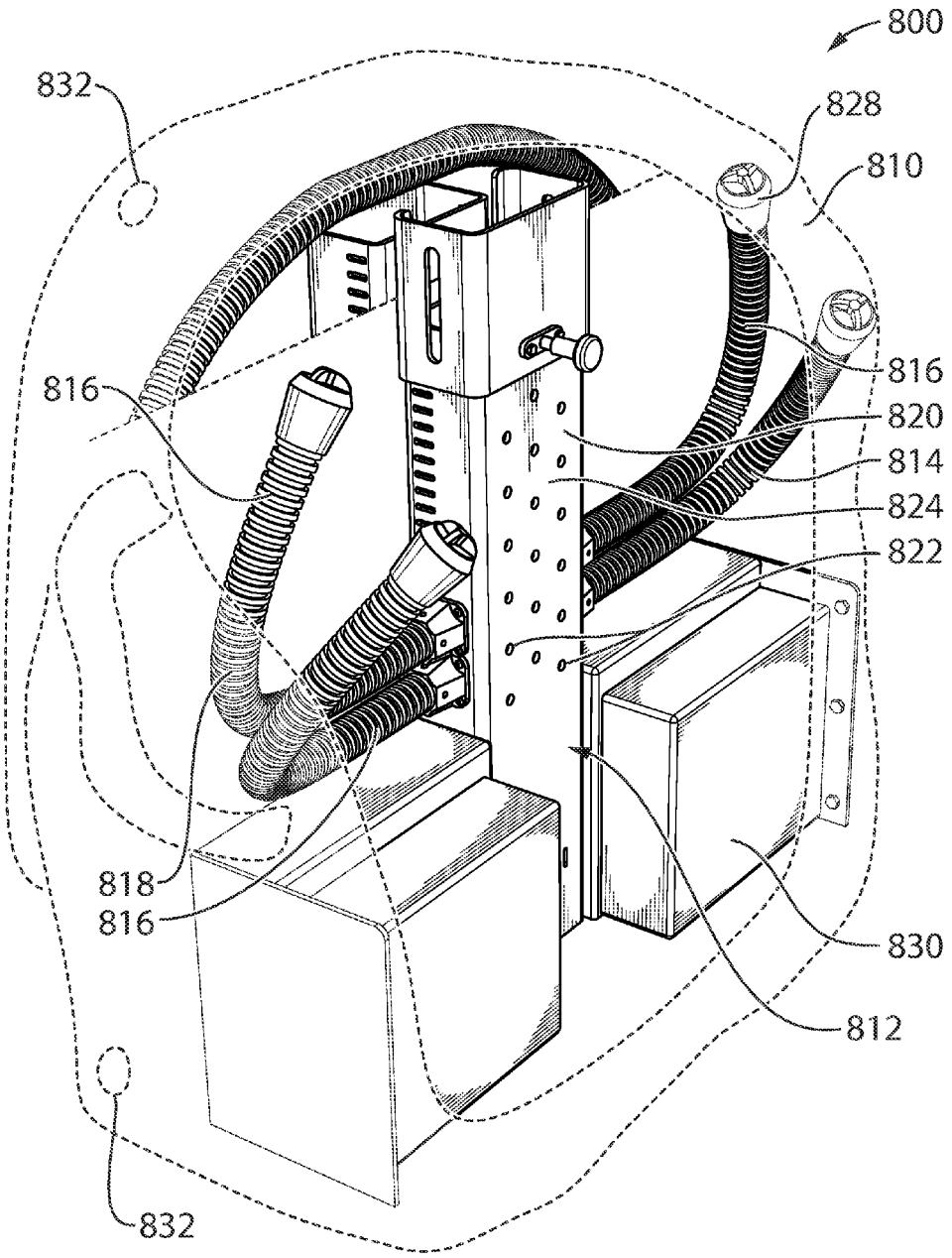
FIG. 11 is a perspective view of the ventilation structure of FIG. 10 in a container in a retracted position.
Figure 12:
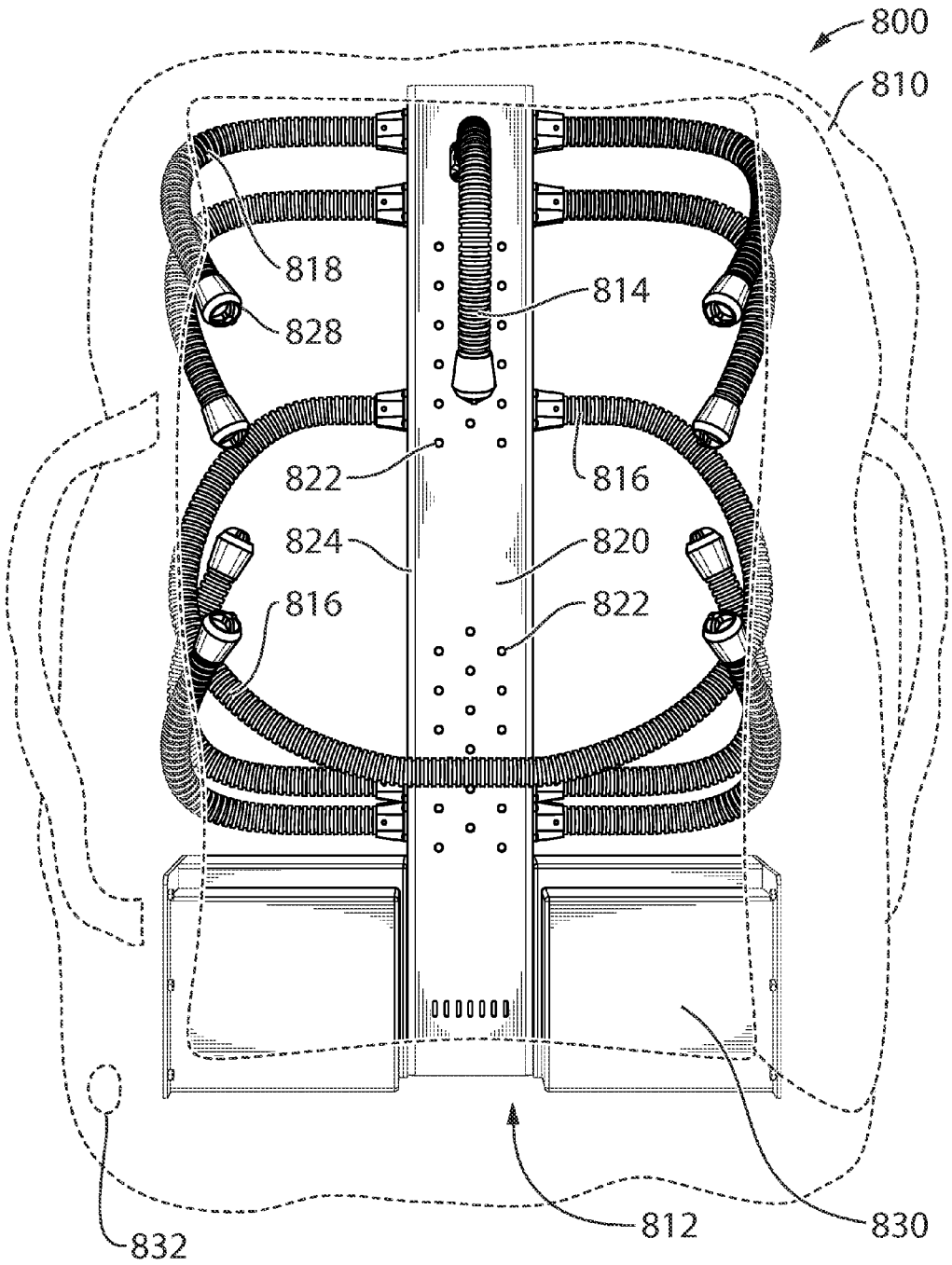
FIG. 12 is a front perspective view of a ventilation structure in a container in an extended position in accordance with another embodiment.

Referring now to FIGS. 10, 11 and 12 there is shown a perspective view of a ventilation structure 812 in a container 800 in an extended position (FIGS. 10 and 12) and in a retracted position (FIG. 11) in accordance with different embodiments. The container 800 is for storing and drying garments or sport equipment. The container 800 comprises an external envelope 810 which comprises a resistant material. The container 800 also comprises a ventilation structure 812 through which air can be blown for drying the garments or sports equipment. The ventilation structure 812 supports the external envelope 810. The ventilation structure 812 comprises hanging elements 814 for hanging the garments or sports equipment thereon. The ventilation structure 812 is also capable of adopting a retracted position and an extended position in which the ventilation structure 812 occupies more space than in the retracted position. The ventilation structure 812 may also comprises a net like system through which air can be blown for drying sports equipment.

In an embodiment, the ventilation structure 812 of the container 800 comprises tubing 816 through which air can be blown and capable of adopting a retracted position and an extended position in which the tubing 816 occupies more space than in the retracted position, the tubing 816 comprising at least some of the hanging elements 814.

In an embodiment, the tubing 816 may comprise at least one of a flexible portion 818, a pivot portion (not shown), and a sliding portion (not shown) enabling the retracted position and the extended position.

In an embodiment, the ventilation structure 812 may further comprise a retractable frame 820 having ventilation holes 822 through which air can be blown for drying the garments or sports equipment, the retractable frame 820 supporting the external envelope 810.

In an embodiment, the retractable frame 820 may further comprise frame sections 824 enabling the retracted position and the extended position.

In an embodiment, the frame sections 824 are capable of at least one of: collapsing into or along each other; and folding toward each other thereby changing the space occupied by the retractable frame 820.

In an embodiment, the ventilation structure 812 may comprise an air input (not shown) and a plurality of air outputs 828 for blowing air on the garments or sports equipment.

In an embodiment, the container 800 may further comprise a ventilator 830 mounted to the ventilation structure 812 and connected to the air input (not shown) of the ventilation structure 812 for providing the blown air.

In an embodiment, the ventilator 830 may further comprise a timer (not shown) for controlling an operating time of the ventilator 830.

In an embodiment, the container 800 may further comprise a battery pack (not shown) mounted on the ventilation structure 812 for providing electrical power to the ventilator 830.

In an embodiment, the container 800 may further comprise an electrical cord (not shown) for connecting the ventilator 830 to an electrical outlet (not shown) to provide electrical power to the ventilator 830.

In an embodiment, the external envelope 810 of the container 800 may comprise an air output port 832 for providing fresh air to the ventilator 830.

In an embodiment, the container 800 may further comprise at least one of a temperature sensor (not shown) and a hygrometry sensor (not shown) for evaluating temperature and hygrometry in the container 800 respectively.

In an embodiment, the container 800 may further comprise at least one of: a disinfectant dispenser (not shown) mounted on the ventilation structure 812 for dispensing a disinfectant composition to the garments or sports equipment; and an odor dispenser (not shown) mounted on the ventilation structure 812 for dispensing an odoriferous composition to the garments or sports equipment.

In an embodiment, the container 800 may further comprise at least one of a temperature level indicator (not shown) and a hygrometry level indicator (not shown).

In an embodiment, the container 800 may further comprise at least one aerated compartment (not shown) extending from the external envelope 810 through which air can be blown for drying the garments or sports equipment in the at least one aerated compartment. For instance, the aerated compartment may be for receiving and drying hockey pads and equipment. The aerated compartment may include a net compartment for receiving sports equipments.

In an embodiment, the external envelope 810 of the container 800 comprises a flexible resistant material.

In a preferred embodiment, the container 800 is a bag. However, the container 800 may be, without limitations, a luggage, a locker, any receptacle and the like.

In an embodiment, the ventilation structure 812 is capable of adopting an intermediate position between the retracted position and the extended position for hanging the garments or the sports equipment.

In an embodiment, the tubing 816 of the ventilation structure 812 is capable of adopting a retracted position inside the frame or the retractable frame 820.

Figure 13:
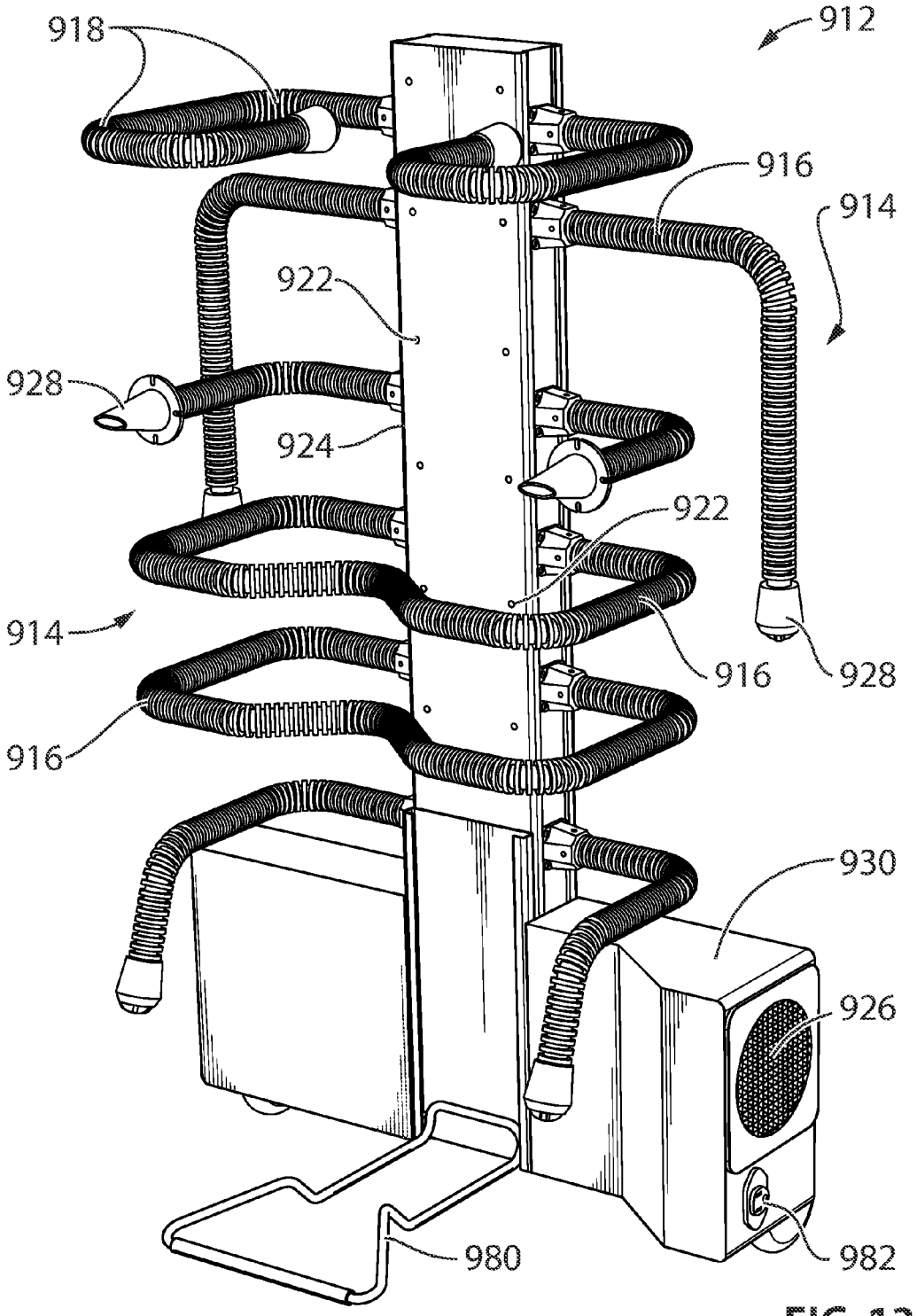
FIG. 13 is perspective view of a ventilation structure in an extended position in accordance with another embodiment.

Referring now to FIG. 13 there is shown a perspective view of a ventilation structure 912 in an extended position in accordance with an embodiment. There is shown a ventilation structure 912 through which air can be blown for drying the garments or sports equipment. The ventilation structure 912 may support an external envelope (not shown). The ventilation structure 912 comprises hanging elements 914 for hanging the garments or sports equipment thereon. The ventilation structure 912 is also capable of adopting a retracted position and an extended position in which the ventilation structure 912 occupies more space than in the retracted position. The ventilation structure 912 may also comprises a net like system through which air can be blown for drying sports equipment.

In an embodiment, the ventilation structure 912 comprises tubing 916 through which air can be blown and capable of adopting a retracted position and an extended position in which the tubing 916 occupies more space than in the retracted position, the tubing 916 comprising at least some of the hanging elements 914.

In an embodiment, the tubing 916 may comprise at least one of a flexible portion 918, a pivot portion (not shown), and a sliding portion (not shown) enabling the retracted position and the extended position.

In an embodiment, the ventilation structure 912 may further comprise a frame 920 having ventilation holes 922 through which air can be blown for drying the garments or sports equipment, the frame 920 for supporting an external envelope 910.

In an embodiment, the ventilation structure 912 may comprise an air input 926 and a plurality of air outputs 928 for blowing air on the garments or sports equipment.

In an embodiment, the ventilation structure 912 may further comprise a ventilator 930 mounted to the ventilation structure 912 and connected to the air input 926 of the ventilation structure 912 for providing the blown air.

In an embodiment, the ventilator 930 may further comprise a timer (not shown) for controlling an operating time of the ventilator 930.

In an embodiment, the ventilation structure 912 may further comprise a battery pack (not shown) mounted on the ventilation structure 912 for providing electrical power to the ventilator 930.

In an embodiment, the ventilation structure 912 may further comprise an electrical cord (not shown) for connecting the ventilator 930 to an electrical outlet (not shown) to provide electrical power to the ventilator 930.

In an embodiment, the ventilation structure 912 may further comprise at least one of a temperature sensor (not shown) and a hygrometry sensor (not shown) for evaluating temperature and hygrometry in the container (not shown) respectively.

In a preferred embodiment, the ventilation structure 912 may be inserted in, without limitations, a bag, a luggage, a locker, a room, any receptacle and the like.

In an embodiment, the ventilation structure 912 is capable of adopting an intermediate position between the retracted position and the extended position for hanging the garments or the sports equipment.

In an embodiment, the tubing 916 of the ventilation structure 912 is capable of adopting a retracted position inside the frame 920.

While preferred embodiments have been described above and illustrated in the accompanying drawings, it will be evident to those skilled in the art that modifications may be made therein without departing from the essence of this disclosure. Such modifications are considered as possible variants comprised in the scope of the disclosure.

The invention claimed is:

1. A container for storing and drying garments or sport equipment, the container comprising:

an external envelope comprising a resistant material; and a ventilation structure through which air can be blown for drying the garments or sports equipment, the ventilation structure supporting the external envelope, the ventilation structure comprising hanging elements for hanging the garments or sports equipment thereon, the ventilation structure capable of adopting a retracted position and an extended position in which the ventilation structure occupies more space than in the retracted position.

2. The container of claim 1, wherein the ventilation structure comprises tubing through which air can be blown and capable of adopting a retracted position and an extended position in which the tubing occupies more space than in the retracted position, the tubing comprising at least some of the hanging elements.

3. The container of claim 2, wherein the tubing comprises at least one of a flexible portion, a pivot portion, and a sliding portion enabling the retracted position and the extended position.

4. The container of claim 1, wherein the ventilation structure further comprises a frame having ventilation holes through which air can be blown for drying the garments or sports equipment, the retractable frame supporting the external envelope.

5. The container of claim 4, wherein the frame comprises a retractable frame.

6. The container of claim 5, wherein the retractable frame further comprises frame sections enabling the retracted position and the extended position.

7. The container of claim 6, wherein the frame sections are capable of at least one of: collapsing into or along each other; and folding toward each other thereby changing the space occupied by the retractable frame.

8. The container of claim 1, wherein the ventilation structure comprises an air input and a plurality of air outputs for blowing air on the garments or sports equipment.

9. The container of claim 8, further comprising a ventilator mounted to the ventilation structure and connected to the air input of the ventilation structure for providing the blown air.

10. The container of claim 8, wherein the ventilator further comprises a timer for controlling an operating time of the ventilator.

11. The container of claim 8, further comprising a battery pack mounted on the ventilation structure for providing electrical power to the ventilator.

12. The container of claim 8, further comprising an electrical cord for connecting the ventilator to an electrical outlet to provide electrical power to the ventilator.

13. The container of claim 8, wherein the external envelope comprises an air entry port for providing fresh air to the ventilator.

14. The container of claim 1, further comprising at least one of a temperature sensor and a hygrometry sensor for evaluating temperature and hygrometry in the container respectively.

15. The container of claim 1, further comprising at least one of: a disinfectant dispenser mounted on the ventilation structure for dispensing a disinfectant composition to the garments or sports equipment; and an odor dispenser mounted on the ventilation structure for dispensing an odoriferous composition to the garments or sports equipment.

16. The container of claim 1, further comprising at least one of a temperature level indicator and a hygrometry level indicator.

17. The container of claim 1, further comprising at least one aerated compartment extending from the external envelope through which air can be blown for drying the garments or sports equipment in the at least one aerated compartment.

18. The container of claim 1, wherein the external envelope comprises a flexible resistant material.

19. The container of claim 1, wherein the container is a bag.

20. The container of claim 1, wherein the ventilation structure is capable of adopting an intermediate position between the retracted position and the extended position for hanging the garments or the sports equipment.

21. The container of claim 1, wherein the tubing of the ventilation structure is capable of adopting a retracted position inside the frame or the retractable frame.

* * * * *